US009914064B2

(12) United States Patent
Daye

(10) Patent No.: US 9,914,064 B2
(45) Date of Patent: Mar. 13, 2018

(54) CHILDREN'S FOAM PLAY DEN

(71) Applicant: Denise Daye, Olympia, WA (US)

(72) Inventor: Denise Daye, Olympia, WA (US)

( * ) Notice: Subject to any disclaimer, the term of this patent is extended or adjusted under 35 U.S.C. 154(b) by 0 days.

(21) Appl. No.: 15/415,193

(22) Filed: Jan. 25, 2017

(65) Prior Publication Data

US 2017/0209800 A1 Jul. 27, 2017

Related U.S. Application Data

(60) Provisional application No. 62/286,544, filed on Jan. 25, 2016.

(51) Int. Cl.

| | |
|---|---|
| ***A63H 3/52*** | (2006.01) |
| ***A63H 33/00*** | (2006.01) |
| ***A47G 9/10*** | (2006.01) |

(52) U.S. Cl.

CPC ..... *A63H 33/008* (2013.01); *A47G 9/10* (2013.01); *A47G 2009/1018* (2013.01)

(58) Field of Classification Search

CPC .. A63H 3/00; A63H 3/52; A63H 33/00; E04B 1/3445; E04B 1/34357; E04B 1/34384; E04H 1/00; E04H 1/1205; E04H 15/00; E04H 15/006; E04H 15/008

USPC ..... 446/476, 478, 72–75; 135/100, 115, 125

See application file for complete search history.

(56) References Cited

U.S. PATENT DOCUMENTS 5,356,354 A 10/1994 Owens
5,525,088 A * 6/1996 Mayne ..... A63H 3/52 206/457
5,562,115 A * 10/1996 Sotelo ..... A45F 4/04 135/100
6,199,230 B1 3/2001 Parikh
6,554,677 B2 4/2003 Leemon
6,892,742 B2 * 5/2005 Wang ..... E04H 15/425 135/115
7,798,163 B2 * 9/2010 Yang ..... A63H 33/008 135/120.3
8,851,956 B2 * 10/2014 Niu ..... E04H 15/006 135/125
2012/0304389 A1 12/2012 Ranck et al.

OTHER PUBLICATIONS

Amazon.com: Jaxx Castle Soft Foam Playhouse for Kids: Toys & Games, https://www.amazon.com/JaxxCastleSoftFoamPlayhouse/dp/B00LV8M5XU/ref=sr_1_5ie=UTF8&qid=1484681906&sr=85&keywords=foam+playhouse, Amazon, Jan. 17, 2017.

* cited by examiner

*Primary Examiner* — Kien Nguyen
(74) *Attorney, Agent, or Firm* — George A. Leone; Citadel Patent Law

(57) ABSTRACT

A foam play den includes a rectangular base having perimeter edges. Walls include two side panel walls, a front wall and a rear wall, where each of the walls have a linear bottom edge and a curved top edge and forms and arched-shaped panel covered by a fabric. A front half section of each curved top edge of each side panel wall is attached to a top edge section of the front wall. A back half section of each side panel wall edge is attached to a top edge section of the back wall at opposing sides. Each of the plurality of walls meet at the high point of their curves to form an apex. The front wall includes an opening sized to accommodate a human entry; and the attached walls form a freestanding den wherein structural support for the den is provided by the joined plurality of walls.

20 Claims, 7 Drawing Sheets

CHILDREN'S FOAM PLAY DEN

RELATED APPLICATION

This is a nonprovisional application of and claims priority from co-pending U.S. provisional application Ser. No. 62/286,544 entitled Cubby Hole, having filing date Jan. 25, 2016, which is incorporated herein by reference.

TECHNICAL FIELD

The present invention relates to a children's foam play den and, more particularly, the invention relates to a self-supporting enclosed, foam play den.

BACKGROUND

There are numerous types of play tents, toy castles, playhouses and other types of structures available for child activities. For example, foam structures comprising interlocking panels are available to be used as a children's playhouse. However, available foam structures do not provide a freestanding, cozy enclosure for children. If an enclosure is desired, children's play tents made of fabric and constructed using tent poles and the like are available.

For example, US patent application entitled "Multi-Purpose Furniture," published as US 2012/0304389, by Ranck et al. discloses multi-purpose furniture that can be redeployed as play-themed structures useable by children. The multi-purpose furniture, in one version, includes slab-like cushion elements. An ornamental graphic having the appearance of vertical wooden logs typical of a fort, large stones typical of a castle wall, or some other graphic is disposed directly on the surface of the foam (if foam is used), or a material encasing the foam (e.g., a woven or nonwoven fabric). These cushion elements may then be connected with one another to assume different configurations, e.g., a comfortable chair, or a structure having the appearance of a fort or other themed context.

In another example, U.S. Pat. No. 8,851,956, issued Oct. 7, 2014 and entitled "Playhouse," to Niu, discloses a playhouse having a main frame, a canopy mounted on and above the main frame, and two roof supporting frames. When the roof supporting frames cross each other, the canopy is propped up and expanded to construct the playhouse into a three-dimensional space. When folding the playhouse, the roof supporting frames are inclined to overlap the main frame.

Many other types of indoor and outdoor play mat's, corrals, forts and the like are available. However, substantially all of the available structures either require separate supports like tent poles to hold up a roof or do not allow for a roof covering the structure.

Lacking in the art is a freestanding children's den which provides a substantially enclosed, soft, roofed structure that is a comfortable and safe place for children. Further, currently available products are not compressible for easy storage and most require assembly of a number of components prior to use.

In a striking improvement over conventionally available children's play structures, the present invention for the first time discloses a children's play den that provides a solution for all of the above issues. Presented here is a children's play den that is freestanding when used for play, and yet can be compressed into a small unit for easy storage using ordinary household devices. The improved unit decompresses into shape without the need for assembly of any structural components. An added benefit of such a den is that it provides a secure environment for children to play in or to sleep in.

BRIEF SUMMARY OF THE DISCLOSURE

This summary is provided to introduce, in a simplified form, a selection of concepts that are further described below in the Detailed Description. This summary is not intended to identify key features of the claimed subject matter, nor is it intended to be used as an aid in determining the scope of the claimed subject matter.

A foam play den includes a rectangular base having perimeter edges. Walls include two side panel walls, a front wall and a rear wall, where each of the walls have a linear bottom edge and a curved top edge and forms an arched-shaped panel covered by a fabric. A front half section of each curved top edge of each side panel wall is attached to a top edge section of the front wall. A back half section of each side panel wall edge is attached to a top edge section of the back wall at opposing sides. Each of the plurality of walls meet at the high point of their curves to form an apex. The front wall includes an opening sized to accommodate a human entry; and the attached walls form a freestanding den wherein structural support for the den is provided by the joined plurality of walls.

BRIEF DESCRIPTION OF THE DRAWINGS

While the novel features of the invention are set forth with particularity in the appended claims, the invention, both as to organization and content, will be better understood and appreciated, along with other objects and features thereof, from the following detailed description taken in conjunction with the drawings, in which:

Figure 1:
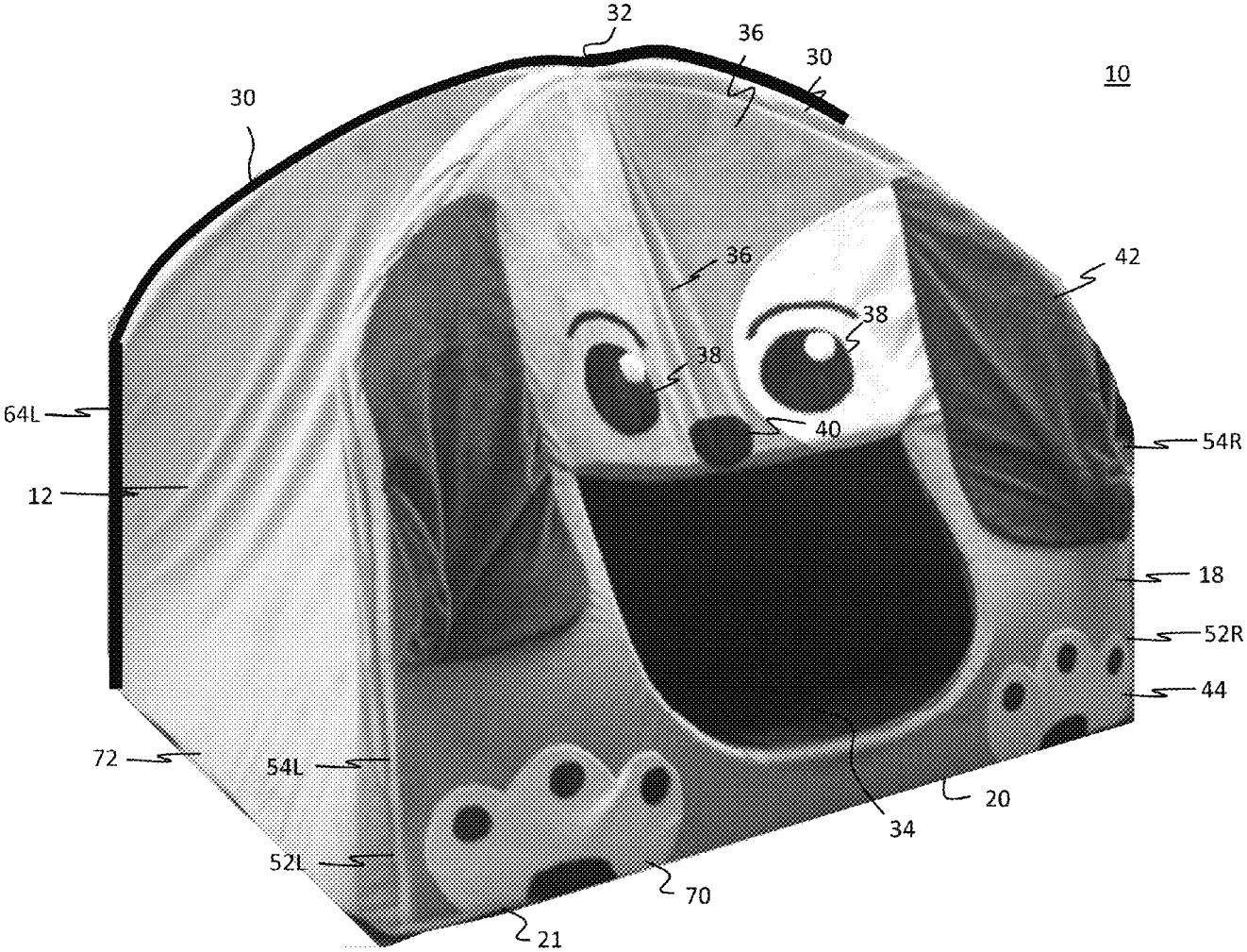
FIG. 1 schematically shows a front perspective view of an example of a children's play den.

In the drawings, identical reference numbers call out similar elements or components. The sizes and relative positions of elements in the drawings are not necessarily drawn to scale. For example, the shapes of various elements and angles are not drawn to scale, and some of these elements are arbitrarily enlarged and positioned to improve drawing legibility. Further, the particular shapes of the elements as drawn, are not necessarily intended to convey any information regarding the actual shape of the particular elements, and have been solely selected for ease of recognition in the drawings.

DETAILED DESCRIPTION OF THE PREFERRED EMBODIMENTS

The following disclosure describes a children's foam play den. Several features of apparatus, methods and systems in accordance with example embodiments are set forth and described in the figures. It will be appreciated that apparatus, methods and systems in accordance with other example embodiments can include additional procedures or features different than those shown in the figures. Example embodiments are described herein with respect to a self-standing children's foam play den with memory foam panels. However, it will be understood that these examples are for the purpose of illustrating the principles, and that the invention is not so limited.

Definitions

Generally, as used herein, the following terms have the following meanings, unless the use in context dictates otherwise:

The use of the word "a" or "an" when used in conjunction with the term "comprising" in the claims or the specification means one or more than one, unless the context dictates otherwise. The term "about" means the stated value plus or minus the margin of error of measurement or plus or minus 10% if no method of measurement is indicated. The use of the term "or" in the claims is used to mean "and/or" unless explicitly indicated to refer to alternatives only or if the alternatives are mutually exclusive. The terms "comprise", "have", "include" and "contain" (and their variants) are open-ended linking verbs and allow the addition of other elements when used in a claim.

As used herein, "plurality" is understood to mean more than one. For example, a plurality refers to at least two, three, four, five, ten or more.

Reference throughout this specification to "one example" or "an example embodiment," "one embodiment," "an embodiment" or combinations and/or variations of these terms means that a particular feature, structure or characteristic described in connection with the embodiment is included in at least one embodiment of the present disclosure. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

"Plush," as used herein, has its ordinary meaning in the art that is a textile having a cut nap or pile the same as fustian or velvet. Modern plush textiles are commonly manufactured from synthetic fibers such as polyester or the like.

"Memory foam," as used herein, has its ordinary meaning as in the art. Typically it comprises polyurethane with additional chemicals increasing its viscosity and density. It is often referred to as "viscoelastic" polyurethane foam, or low-resilience polyurethane (LRPu) foam.

Description

Figure 2:
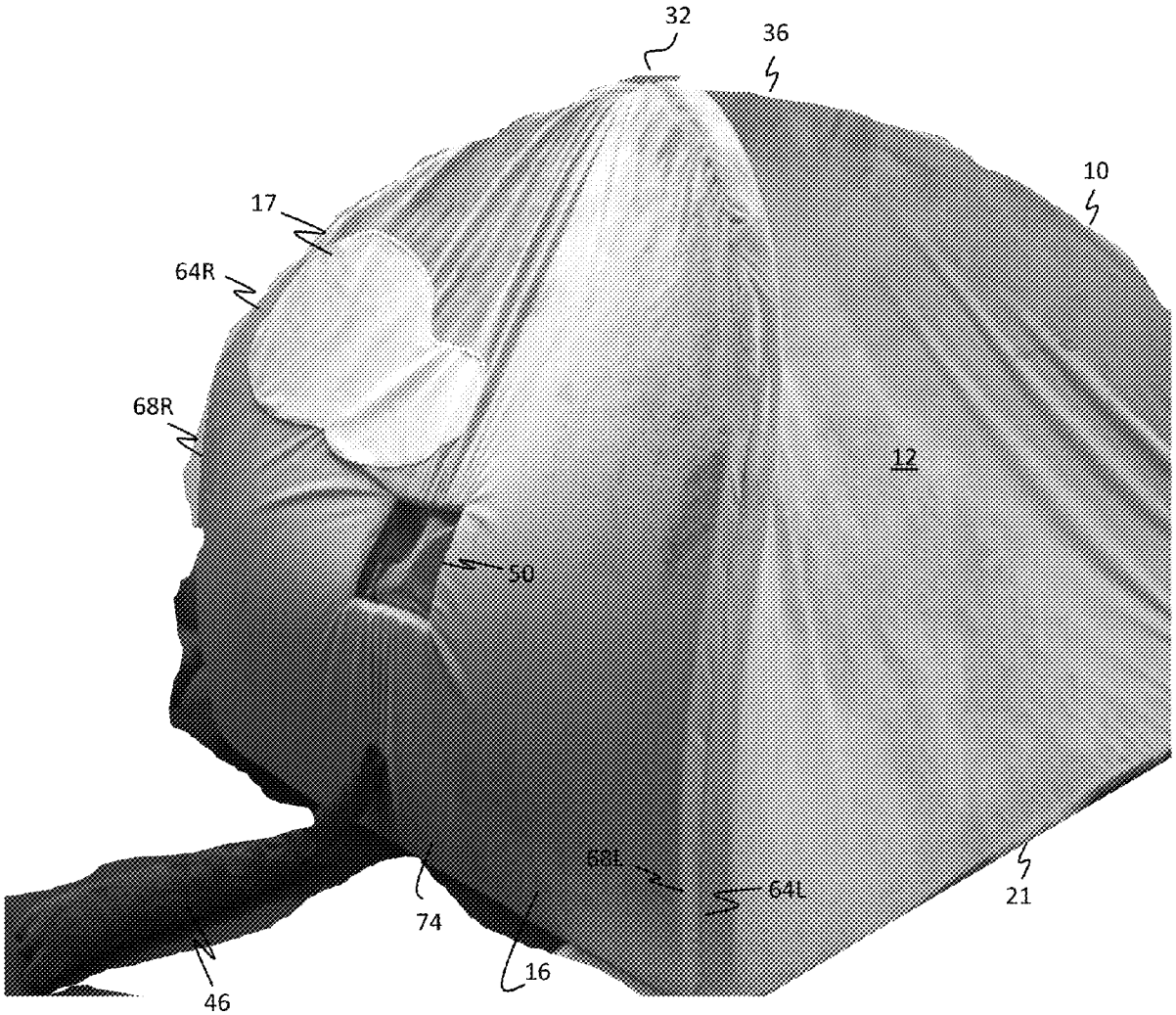
FIG. 2 schematically shows a rear perspective view of an example of a children's play den.
Figure 7:
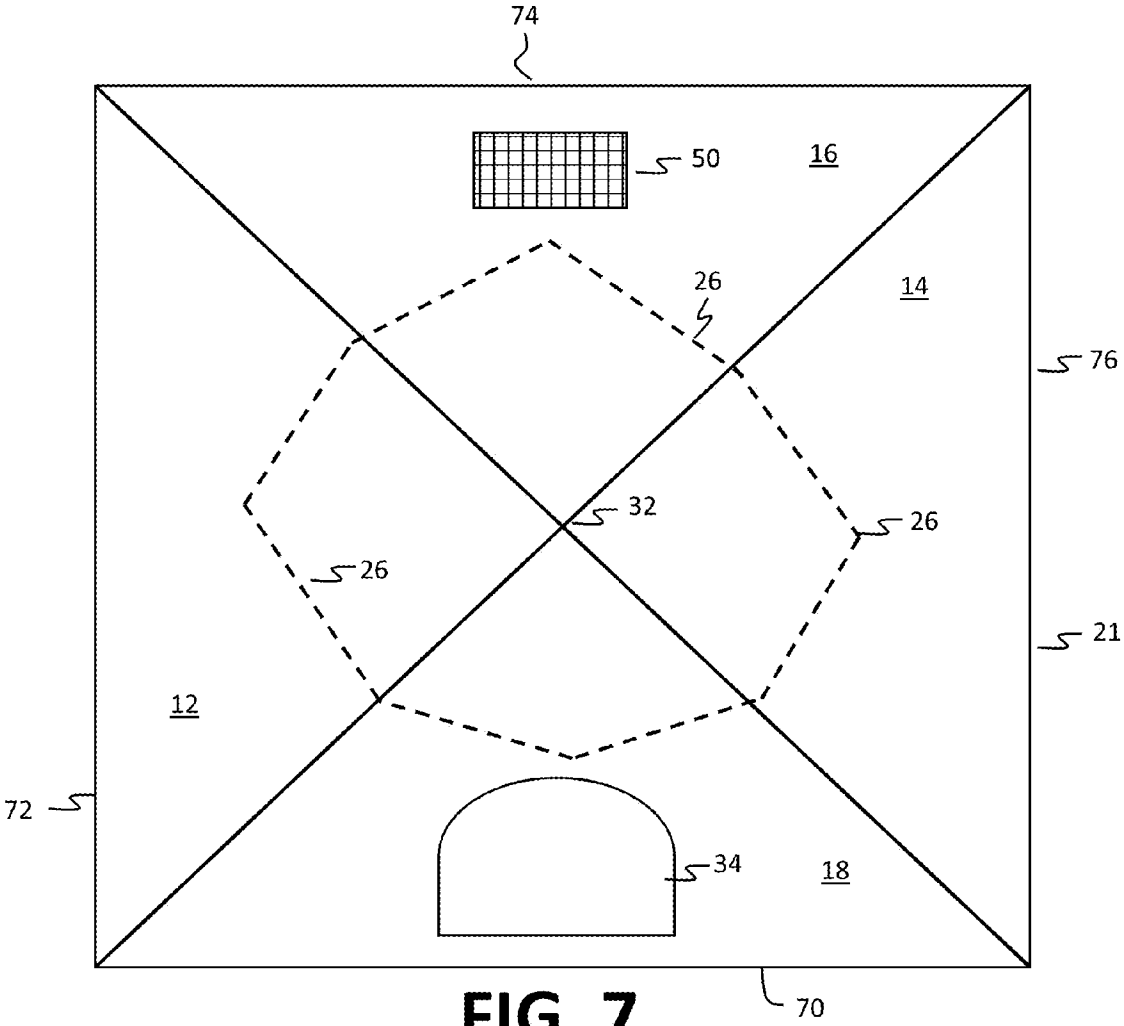
FIG. 7 schematically illustrates a top plan view of an example of a children's play den.

Referring now jointly to FIG. 1 and FIG. 2, front and rear perspective views of an example of a children's play den are schematically shown. A children's foam play den 10 includes a rectangular base 20, having a plurality of perimeter edges 21. A plurality walls, including two side panel walls 12, 14 (as shown in FIG. 7), a front panel wall 18 and a rear panel wall 16, where each of the plurality walls have a substantially straight linear bottom edge and an arched top edge 30. In one useful example, each of the plurality walls comprises an arched-shaped memory foam panel as described in more detail below.

The plurality of walls are advantageously attached together with the base to form a children's play den 10. The play den is formed by joining a front half section of each curved top edge 52L, 52R of each side panel wall 12,14 to first and second half sections 54L, 54R of the top edge of the front wall 18. A back half section 64L,64R of each side panel wall edge is attached to a first half section of the top edge 68L, 68R of the back wall. A central apex 32 is formed where the plurality of walls meet at the high point of their curved edges. Finally, the linear bottom edges 70, 72, 74, 76 (as shown in FIG. 7) of each of the plurality of walls are linearly attached along the length of a different one of the plurality of base perimeter edges 21. Once joined together in this fashion, the plurality of walls and base form a free-standing den wherein structural support for the den is provided by the joined plurality of walls in an uncompressed memory foam state. In one example, the front panel wall 18 includes an opening 34 sized to accommodate a human entry port. In one example, each of the plurality of walls may advantageously be covered by a fabric, such as, for example, plush material or the like. Various color combinations may be used.

In one particularly advantageous example, the arched-shaped memory foam panels comprise memory foam that has a density between 1.87 lb/cf-2.56 lb/cf. the plurality of walls and base is adapted to be compressed into a vacuum storage sealed bag for easy storage and transportation. When ready to use again, the plurality of walls and the base are adapted to self-expand when removed from the vacuum storage sealed bag. In any time from one to four hours after removal from the vacuum storage bag, the panels will reform into the play den. A removable fabric-covered foam base pad and a removable pillow may also be inserted into the den as explained further below.

While the panels and den may be made in various sizes and shapes, in one useful example, the plurality of walls each have substantially identical dimensions. For example the base may be at least 4×4 feet, the vertical height of the apex maybe at least 27 inches and the outside length of a side wall edge maybe about 47 inches from base to apex. In another example the base may be at least 6×6 feet with correspondingly increased height and exterior dimensions.

In a particularly advantageous example for children, the foam play den includes aesthetic markings, such as an animal face and appendages applied to the front panel, wherein the opening whimsically forms the mouth of an animal. The animal face 36 includes a nose 40, eyes 38 and ears 42. Feet 44 may be added for enhancing the design. In one example, the ears may also form pockets for storing other toys, stuffed animals and the like. Particularly advantageous whimsical animal faces may include dogs, cats, bears, rabbits and the like. Tails, paws and other animal features may be included in the design of the play den as desired.

Referring now specifically to FIG. 2, a rear perspective view of the children's play den is schematically shown. A rear wall panel 16 is joined at its edges on one side to the left side panel 12 and on the opposite side to the right side panel 14 (as shown in FIG. 7). A tail 46 is advantageously attached to the bottom of the rear wall panel 16. A screened vent 50 is cut into a midportion of the rear wall panel 16. A design element 17 compatible with the design on the front panel may also be included. For example, it may be stitched to the exterior of the rear wall panel.

Figure 3:
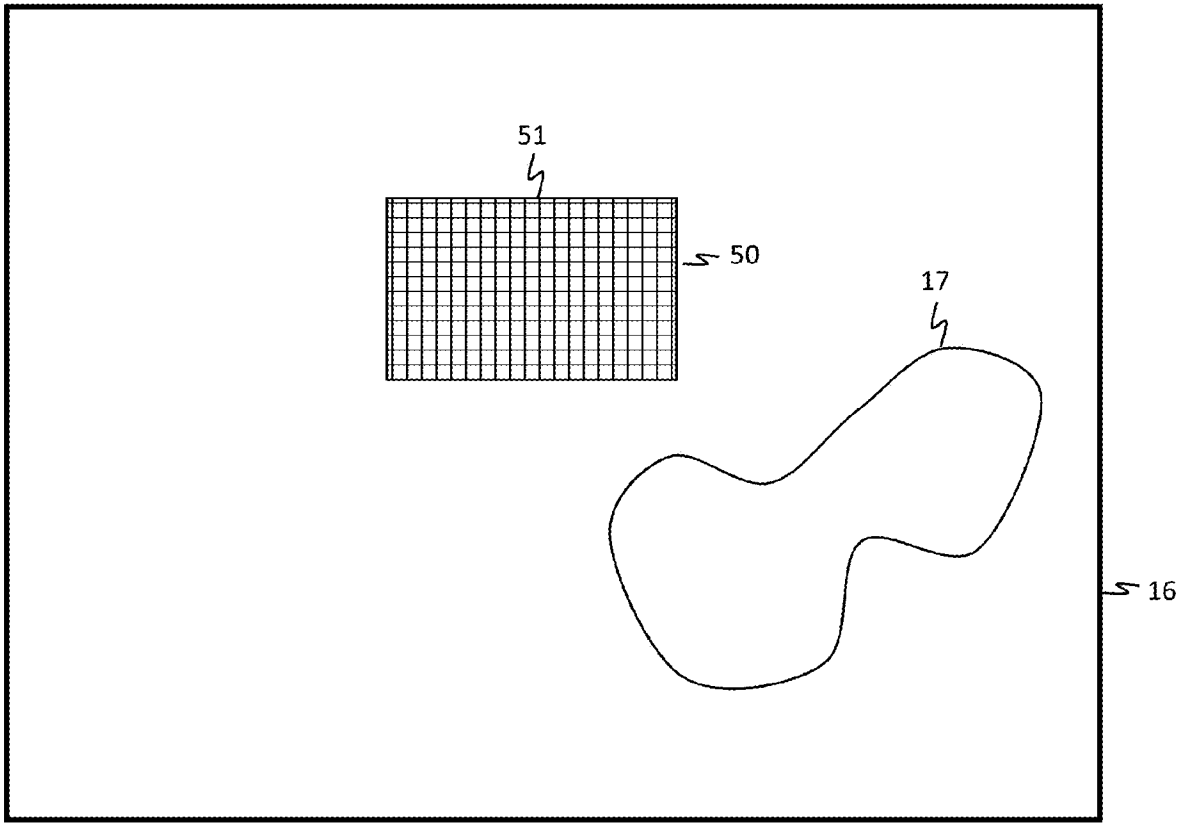
FIG. 3 schematically shows a more detailed example of a back panel of an example of a children's play den.

Referring now to FIG. 3, a more detailed example of a back panel of an example of a children's play den is schematically shown. As described above, a vent 50 may be covered by a screen 51. The screen may be any flexible screening fabric that will let air flow through the interior of the play den.

Figure 4:
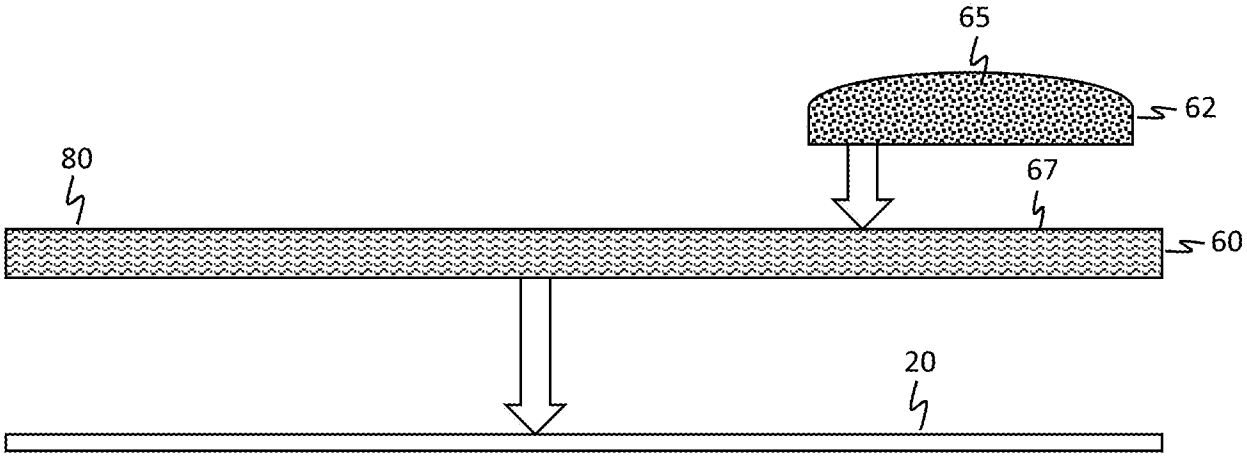
FIG. 4 schematically shows a cutaway side view of base, removable base pad and pillow components used in an example of a children's play den.

Referring now to FIG. 4, a cutaway side view of base, removable base pad and pillow components used in an example of a children's play den is schematically shown. A padded or foam floor pad 60 and a pillow 62 may be inserted into the play den through the mouth. The floor pad and pillow provide extra comfort for the occupants. The pillow may be made of any typical pillow material, and in one example may be made of plush fabric covering pillow stuffing 65, such as polyester fill, foam or the like. The floor pad 60 may also be made of plush or other fabric 80 covering a lighter density foam 67, for example. The base 20 may comprise any durable fabric such as nylon, polyester, cotton, or the like.

Figure 5A:
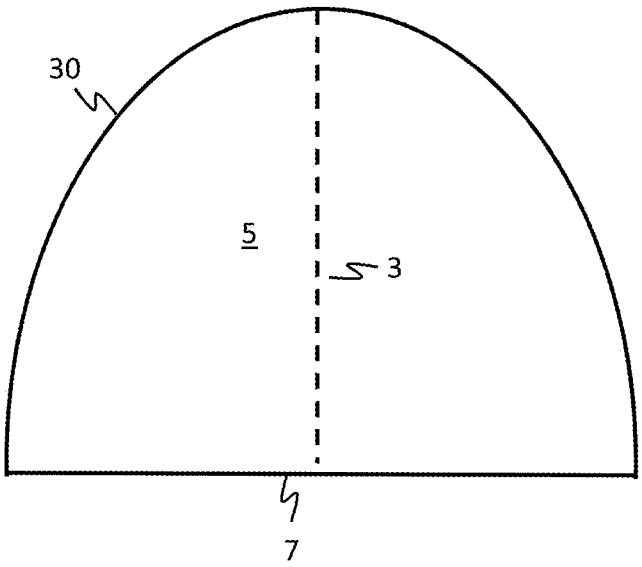
FIG. 5A schematically illustrates a front plan view of a fabric-covered foam wall panel before assembly into the play den.
Figure 5:
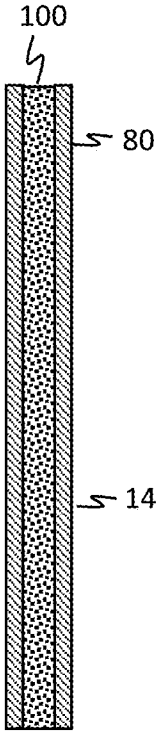
FIG. 5 schematically illustrates a cutaway view of a fabric-covered foam wall panel.

Referring now to FIG. 5, a cutaway view of a fabric-covered foam wall panel is schematically shown. Here shown is a cutaway that may represent a section of any of the left side panel, right side panel, rear panel or front panel walls. For this example the right side panel wall 14 has been selected for exemplary purposes. The side panel wall 14 comprises a sandwich construction including a memory foam interior 100 covered by plush fabric 80. It will be understood that all of the foam wall panels 12, 14, 16 and 18 are similarly constructed.

Referring now to FIG. 5A, a front plan view of a fabric-covered foam wall panel before assembly into the play den is schematically illustrated. Here shown is a front plan view of a foam wall 5 prior to attachment to the other walls or the base. The wall is made of material that is flexible enough to bend or crease as needed to form the play den. The wall comprises a linear bottom edge 7 and a top arched edge 30. Each of the walls may initially be fabricated in this way. Of course the front and back panel walls are modified to accommodate their openings and design features. Each wall may be substantially bifurcated along broken line 3 to provide 2 top edge sections which may be then stitched between 2 adjacent panels.

Figure 6:
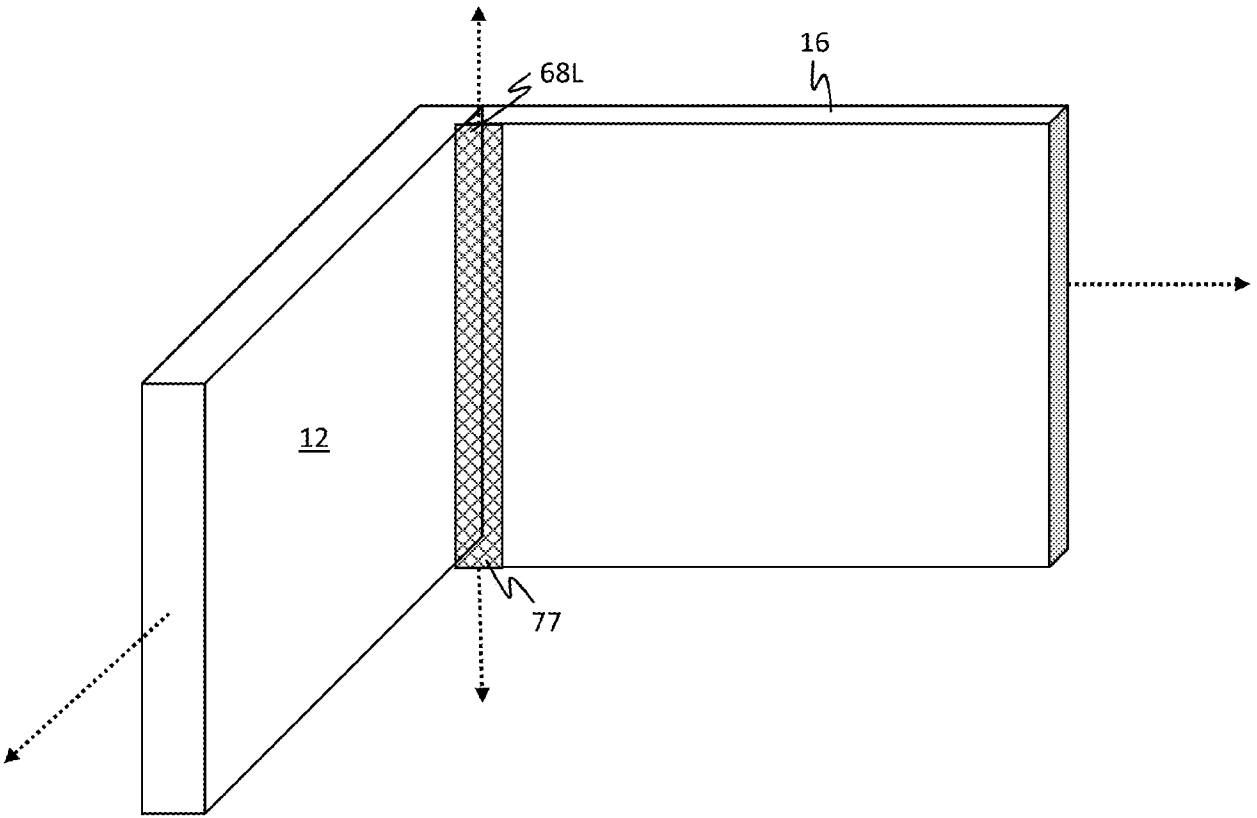
FIG. 6 schematically illustrates edge attachment of adjacent foam wall panels.

Referring now to FIG. 6, edge attachment of adjacent foam wall panels is schematically shown. In this example the left side wall panel 12 is shown attached at age at a back half section of its edge 64L to a portion of the rear panel edge 68L. The edges are stitched or otherwise together as indicated by stitching 77. When covering a wall with fabric, some excess fabric extends beyond the surface of the wall to provide a strip of fabric or seam around the wall edge which is stitched to a corresponding strip of fabric on an adjacent wall edge. Typically, nylon stitching may be used. In this way, the edges of the plurality of panels are stitched to fabric seams of adjacent panels. The panels are joined by stitching the strips together. The panels are arranged so that the left and right side panels are in opposition to each other and the front and rear panels are attached between the left and right panels forming an open space around the perimeter of the base. All of the panels are ultimately joined at the apex to complete the den. The broken line arrows are intended to illustrate that only a portion of the panels are shown and that the panels continue substantially in the directions as shown by the arrows.

Referring now to FIG. 7, a top plan view of an example of a children's play den is schematically shown. As discussed above, in order to form a den, the plurality of wall panels must meet at an apex at the top while being individually attached to a perimeter edge of the base 21. In order to form this shape, each of the foam panel walls 12, 14, 16 and 18 are creased inwardly in a vertical direction at a transverse angle to the base. The crease is here represented by broken lines 26.

In yet another example, the foam play den may be packaged in a vacuum sealed package as a kit. The kit may include a rectangular base having a plurality of perimeter edges; a plurality walls including two side panel walls, a front wall and a rear wall, where each of the plurality walls have a linear bottom edge and a curved top edge; wherein each of the plurality walls comprises an arched-shaped memory foam panel. The may include the plurality of walls, pad, pillow and other elements constructed as described above.

The invention has been described herein in considerable detail in order to comply with the patent Statutes and to provide those skilled in the art with the information needed to apply the novel principles of the present invention, and to construct and use such exemplary and specialized components as are required. However, it is to be understood that the invention may be carried out by different equipment, and devices, and that various modifications, both as to the equipment details and operating procedures, may be accomplished without departing from the true spirit and scope of the present invention.

What is claimed is:

1. A children's foam play den comprising:

a rectangular base having a plurality of perimeter edges;

a plurality walls including two side panel walls, a front wall and a rear wall, where each of the plurality walls have a substantially straight linear bottom edge and a curved top edge;

wherein each of the plurality walls comprises an arched-shaped memory foam panel;

wherein each of the plurality walls is creased inwardly in a vertical direction at a transverse angle to its linear bottom edge;

wherein each of the plurality of walls is covered by a fabric;

wherein a front half section of each curved top edge of each side panel wall is attached to a top edge section of the front wall;

wherein a back-half section of each side panel wall edge is attached to a top edge section of the back wall, and where the plurality of walls form a central apex where each of the plurality of walls meet at the high point of their curves;

wherein the linear bottom edges of each of the plurality of walls are linearly attached along the length of a different one of the plurality of perimeter edges;

wherein the front wall includes an opening sized to accommodate a human entry; and wherein the plurality of walls and base form a freestanding den wherein structural support for the den is provided by the joined plurality of walls operating as uncompressed memory foam.

2. The foam play den of claim 1 wherein the fabric comprises plush material.

3. The foam play den of claim 1 wherein arched-shaped memory foam panel comprises memory foam that has densities between 1.87lb/cf-2.56lb/cf.

4. The foam play den of claim 1 wherein aesthetic markings, such as an animal face and appendages are applied to the front panel, wherein the opening forms the mouth of an animal.

5. The foam play den of claim 1 wherein the plurality of walls and base is adapted to be compressed into a vacuum storage sealed bag.

6. The foam play den of claim 5 wherein the plurality of walls and the base are adapted to self-expand when removed from the vacuum storage sealed bag.

7. The foam play den of claim 1 wherein the base is at least 4×4 feet, the vertical height of the apex is at least 27 inches and the outside length of a side wall edge is about 47 inches from base to apex.

8. The foam play den of claim 1 wherein the plurality of walls each have substantially identical dimensions.

9. The foam play den of claim 1 further comprising a removable fabric-covered foam base pad and a removable pillow.

10. The foam play den of claim 4 further comprising a tail attached to the exterior of at least one of the panels.

11. A kit for a children's foam play den comprising:

a self-standing play den including:

a rectangular base having a plurality of perimeter edges;

a plurality walls including two side panel walls, a front wall and a rear wall, where each of the plurality walls have a linear bottom edge and a curved top edge;

wherein each of the plurality walls is adapted to be creased inwardly in a vertical direction at a transverse angle its linear bottom edge when assembled;

wherein each of the plurality walls comprises an arched-shaped memory foam panel;

wherein each of the plurality of walls is covered by a fabric;

wherein a front half section of each curved top edge of each side panel wall is attached to a top edge section of the front wall;

wherein a back-half section of each side panel wall edge is attached to a top edge section of the back wall, and where the plurality of walls form a central apex where each of the plurality of walls meet at the high point of their curves;

wherein the linear bottom edges of each of the plurality of walls are linearly attached along the length of a different one of the plurality of perimeter edges;

wherein the front wall includes an opening sized to accommodate a human entry;

wherein the plurality of walls form a freestanding den wherein structural support for the den is fully provided by the joined plurality of walls when decompressed;

a fabric-covered foam base pad; and a pillow.

12. The kit of claim 11 wherein the fabric comprises plush material.

13. The kit of claim 11 wherein arched-shaped memory foam panel comprises memory foam that has a density between 1.87lb/cf-2.56lb/cf.

14. The kit of claim 11 the elements of the kit form a play den having a whimsical face when decompressed.

15. The kit of claim 11 wherein the plurality of walls and base is adapted to be compressed into a vacuum storage sealed bag.

16. The kit of claim 15 wherein the plurality of walls and the base is adapted to self-expand when removed from the vacuum storage sealed bag.

17. The kit den of claim 11 wherein the base is at least 4×4 feet, the vertical height of the apex is at least 27 inches and the outside length of a side wall edge is about 47 inches from base to apex.

18. The kit of claim 1 wherein the plurality of walls have substantially identical dimensions.

19. A children's foam play den comprising:

a rectangular base having a plurality of perimeter edges;

a plurality walls including two side panel walls, a front wall and a rear wall, where each of the plurality walls have a linear bottom edge and a curved top edge;

wherein each of the plurality walls is creased inwardly in a vertical direction at a transverse angle to its linear bottom edge;

wherein each of the plurality walls comprises an arched-shaped memory foam panel, wherein each arched-shaped memory foam panel includes memory foam that has densities between 1.87lb/cf-2.56lb/cf and is covered by a plush fabric;

wherein a front half section of each curved top edge of each side panel wall is attached to a top edge section of the front wall;

wherein a back-half section of each side panel wall edge is attached to a top edge section of the back wall, and where the plurality of walls form a central apex where each of the plurality of walls meet at the high point of their curves;

wherein the linear bottom edges of each of the plurality of walls are linearly attached along the length of a different one of the plurality of perimeter edges;

wherein the front wall includes an opening sized to accommodate a human entry;

wherein the plurality of walls form a freestanding den wherein structural support for the den is fully provided by the joined plurality of walls; and wherein aesthetic markings, such as an animal face and appendages are applied to the front panel, wherein the opening forms the mouth of an animal.

20. The foam play den of claim 19 wherein the plurality of walls and base is adapted to be compressed into a vacuum storage sealed bag and adapted to self-expand when removed from the vacuum storage sealed bag.

* * * * *